US009869492B2

(12) United States Patent
Zimmermann

(10) Patent No.: US 9,869,492 B2
(45) Date of Patent: Jan. 16, 2018

(54) AIR CONDITIONING AND REFRIGERATION SYSTEM

(71) Applicant: Heatcraft Refrigeration Products LLC, Stone Mountain, GA (US)

(72) Inventor: Augusto J. Pereira Zimmermann, Lilburn, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 120 days.

(21) Appl. No.: 14/880,531

(22) Filed: Oct. 12, 2015

(65) Prior Publication Data

US 2017/0102169 A1 Apr. 13, 2017

(51) Int. Cl.

| | |
|---|---|
| ***F25B 7/00*** | (2006.01) |
| ***F25B 5/00*** | (2006.01) |
| ***F25B 49/02*** | (2006.01) |
| *F25B 1/10* | (2006.01) |

(52) U.S. Cl.

CPC ..... *F25B 7/00* (2013.01); *F25B 5/00* (2013.01); *F25B 49/02* (2013.01); *F25B 1/10* (2013.01); *F25B 2400/0409* (2013.01); *F25B 2400/075* (2013.01); *F25B 2400/13* (2013.01); *F25B 2400/23* (2013.01); *F25B 2600/2501* (2013.01); *F25B 2700/197* (2013.01); *F25B 2700/2104* (2013.01); *F25B 2700/2117* (2013.01)

(58) Field of Classification Search

CPC .... F25B 7/00; F25B 9/00; F25B 49/02; F25B 41/04; F25B 1/10; F25B 40/00; F25B 41/003; F25B 2700/2014; F25B 2700/2117; F25B 2600/2501; F25B 2400/0409; F25B 2400/075; F25B 2400/13; F25B 2400/23; F25B 5/00

USPC ..... 62/500, 512

See application file for complete search history.

(56) References Cited

U.S. PATENT DOCUMENTS

| | | | | |
|---|---|---|---|---|
| 5,337,574 | A * | 8/1994 | Dick | F24F 1/022 165/244 |
| 2009/0223232 | A1* | 9/2009 | Rolfsman | F25B 47/02 62/80 |
| 2010/0199694 | A1* | 8/2010 | Taras | F25B 1/10 62/117 |
| 2011/0023514 | A1* | 2/2011 | Mitra | F25B 1/10 62/222 |

(Continued)

FOREIGN PATENT DOCUMENTS

| | | |
|---|---|---|
| EP | 1 426 711 A2 | 10/2003 |
| EP | 2 690 376 A1 | 7/2013 |
| WO | WO 2009/041959 A1 | 4/2009 |

OTHER PUBLICATIONS

European Patent Office Extended Search Report for Application No./Patent No. 16193593.7-1602, Feb. 14, 2017.

*Primary Examiner* — Mohammad M Ali
(74) *Attorney, Agent, or Firm* — Baker Botts L.L.P.

(57) ABSTRACT

A system includes a high side heat exchanger, a modulating valve, a flash tank, and a refrigeration unit. The high side heat exchanger is configured to remove heat from refrigerant. The modulating valve is configured to control the flow of refrigerant from the high side heat exchanger to both a heat exchanger and a flash tank. The flash tank is configured to store refrigerant from the heat exchanger and from the high side heat exchanger. The refrigeration unit is configured to receive refrigerant from the flash tank.

17 Claims, 3 Drawing Sheets

(56) References Cited

U.S. PATENT DOCUMENTS

| | | | | |
|---|---|---|---|---|
| 2011/0048041 | A1* | 3/2011 | Asprovski | F25B 1/10 62/115 |
| 2011/0138825 | A1* | 6/2011 | Chen | F25B 1/10 62/115 |
| 2012/0011866 | A1* | 1/2012 | Scarcella | F25B 1/10 62/79 |
| 2012/0192579 | A1* | 8/2012 | Huff | B60H 1/3232 62/115 |
| 2013/0298593 | A1 | 11/2013 | Christensen | |
| 2013/0312376 | A1* | 11/2013 | Huff | F25B 1/10 55/457 |
| 2014/0026610 | A1* | 1/2014 | Kim et al. | F24D 11/02 62/324.6 |
| 2014/0151015 | A1* | 6/2014 | Sun | F25B 9/008 165/253 |
| 2015/0007591 | A1* | 1/2015 | Liu | G01K 13/02 62/77 |
| 2015/0219379 | A1* | 8/2015 | Sun | F25B 49/022 62/115 |

* cited by examiner

AIR CONDITIONING AND REFRIGERATION SYSTEM

TECHNICAL FIELD

This disclosure relates generally to an air conditioning and refrigeration system specifically an air conditioning and refrigeration system in a carbon dioxide booster system.

BACKGROUND

Air conditioning systems and refrigeration systems may be integrated in a carbon dioxide booster system. This integrated system may cycle refrigerant to cool a space using air conditioning and to cool a space using refrigeration. However, certain configurations of the system may lack control on the refrigerant flow in the air conditioning line. Certain configuration may also cause high pressure drops in the refrigerant line. Furthermore, certain configurations may cause oil to build up in the air conditioning system.

SUMMARY OF THE DISCLOSURE

According to one embodiment, a system includes a high side heat exchanger, a modulating valve, a flash tank, and a refrigeration unit. The high side heat exchanger is configured to remove heat from refrigerant. The modulating valve is configured to control the flow of refrigerant from the high side heat exchanger to both a second heat exchanger and a flash tank. The flash tank is configured to store refrigerant from the second heat exchanger and from the high side heat exchanger. The refrigeration unit is configured to receive refrigerant from the flash tank.

According to another embodiment, a system includes a modulating valve, a motor, and a controller. The modulating valve controls a flow of refrigerant to both a heat exchanger and a flash tank. The motor adjusts the modulating valve. The controller determines whether the modulating valve should direct refrigerant to the heat exchanger. In response to a determination that the modulating valve should direct refrigerant to the heat exchanger, the controller controls the motor to adjust the modulating valve to direct refrigerant to both the heat exchanger and to the flash tank. In response to a determination that the modulating valve should direct refrigerant away from the heat exchanger, the controller controls the motor to adjust the modulating valve to direct all of the refrigerant flowing through the modulating valve to the flash tank.

According to another embodiment, a method includes determining whether a modulating valve should direct refrigerant to a heat exchanger. The modulating valve controls the flow of refrigerant from the high side heat exchanger to both the heat exchanger and a flash tank. The method also includes in response to a determination that the modulating valve should direct refrigerant away from the heat exchanger, adjusting the modulating valve to direct refrigerant to the flash tank. The method further includes in response to a determination that the modulating valve should to direct refrigerant to the heat exchanger, adjusting the modulating valve to direct refrigerant to both the heat exchanger and the flash tank. The flash tank stores refrigerant from the heat exchanger and from the high side heat exchanger. The flash tank further releases refrigerant to a refrigeration unit.

Certain embodiments may provide one or more technical advantages. For example, an embodiment may allow for the flow of refrigerant in the air conditioning system to be controlled, which may reduce the pressure drop in the refrigerant line between the high side heat exchanger and the flash tank. As another example, an embodiment may reduce oil buildup in the air conditioning system, which may increase the efficiency and lifespan of the air conditioning system. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
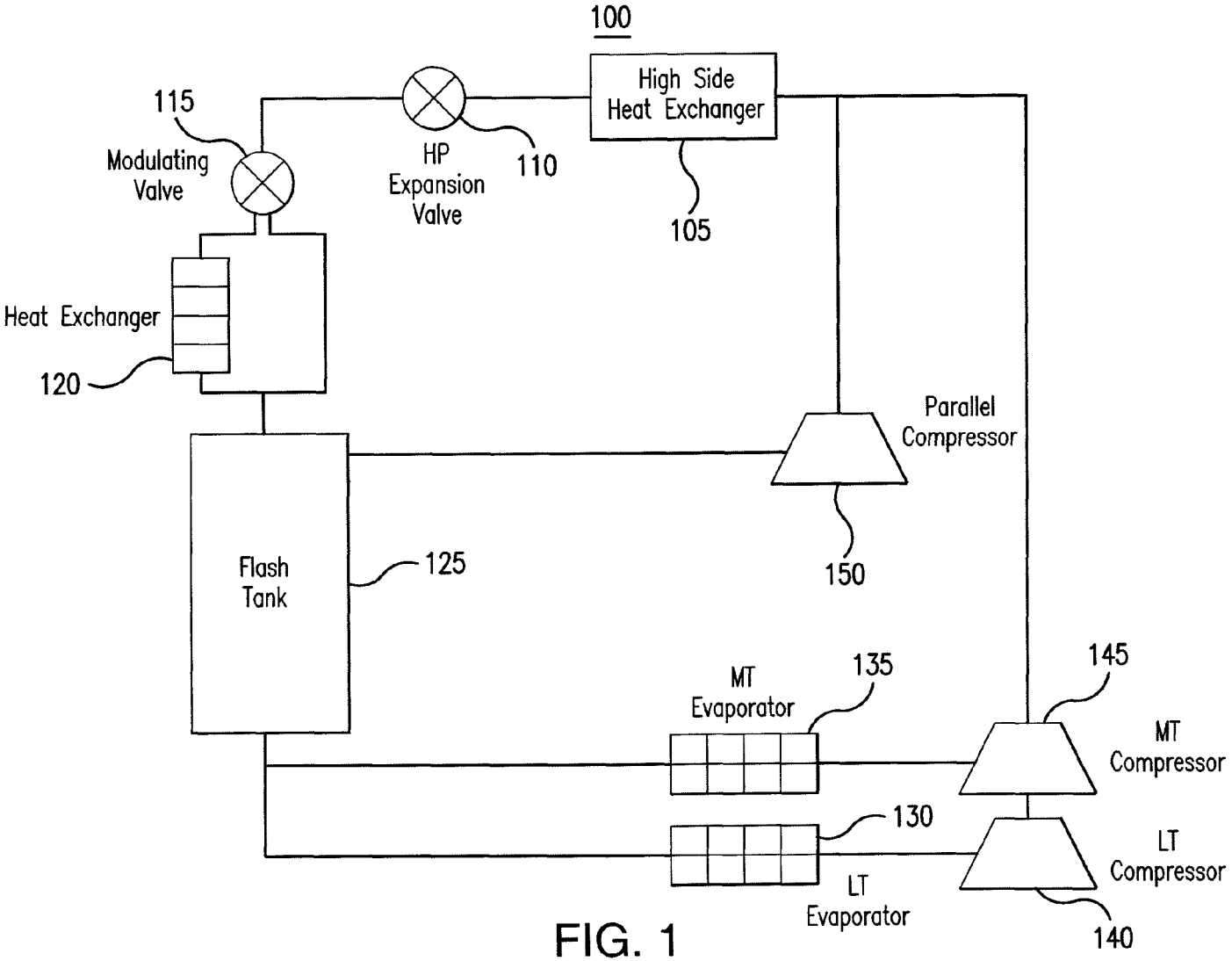
FIG. 1 illustrates an example air conditioning and refrigeration system.
Figure 2:
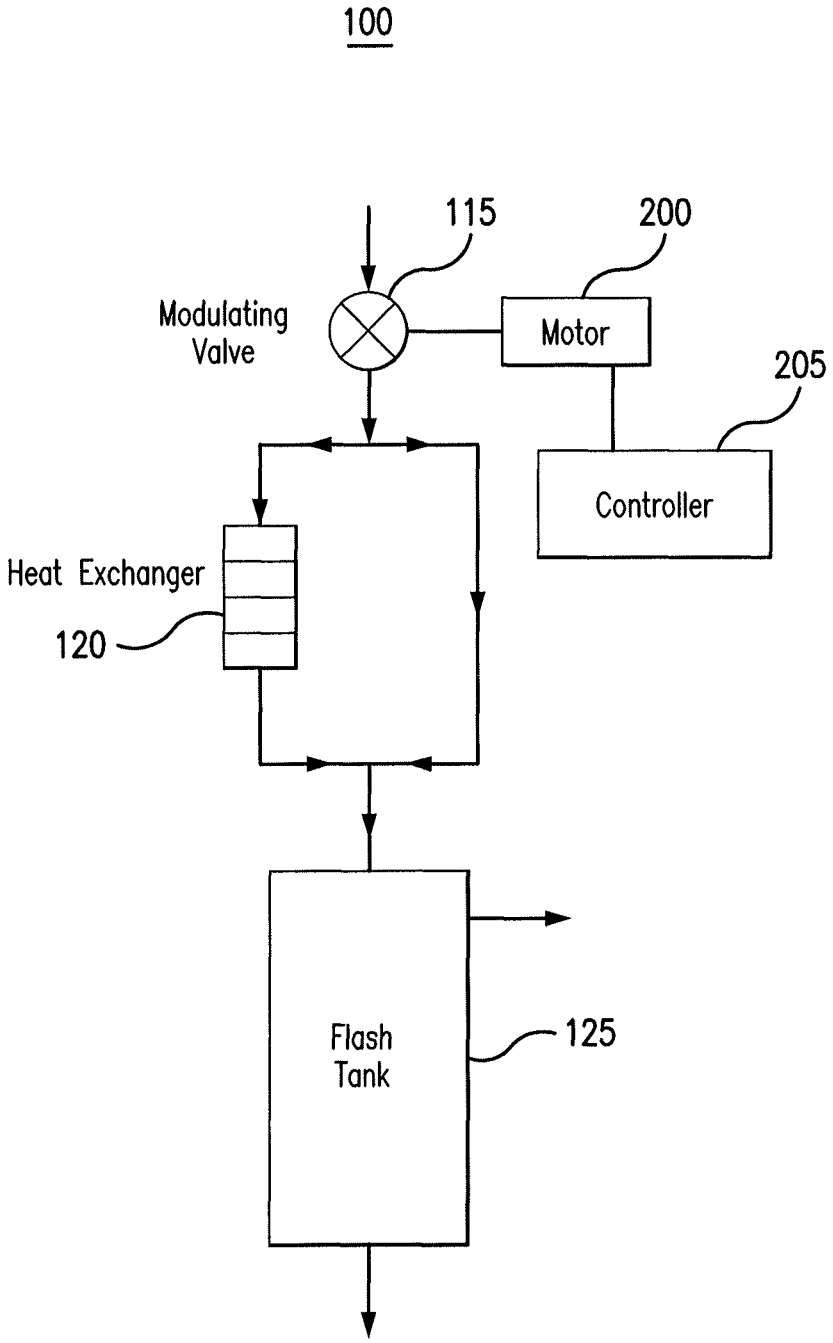
FIG. 2 illustrates an example air conditioning branch of the system of FIG. 1.
Figure 3:
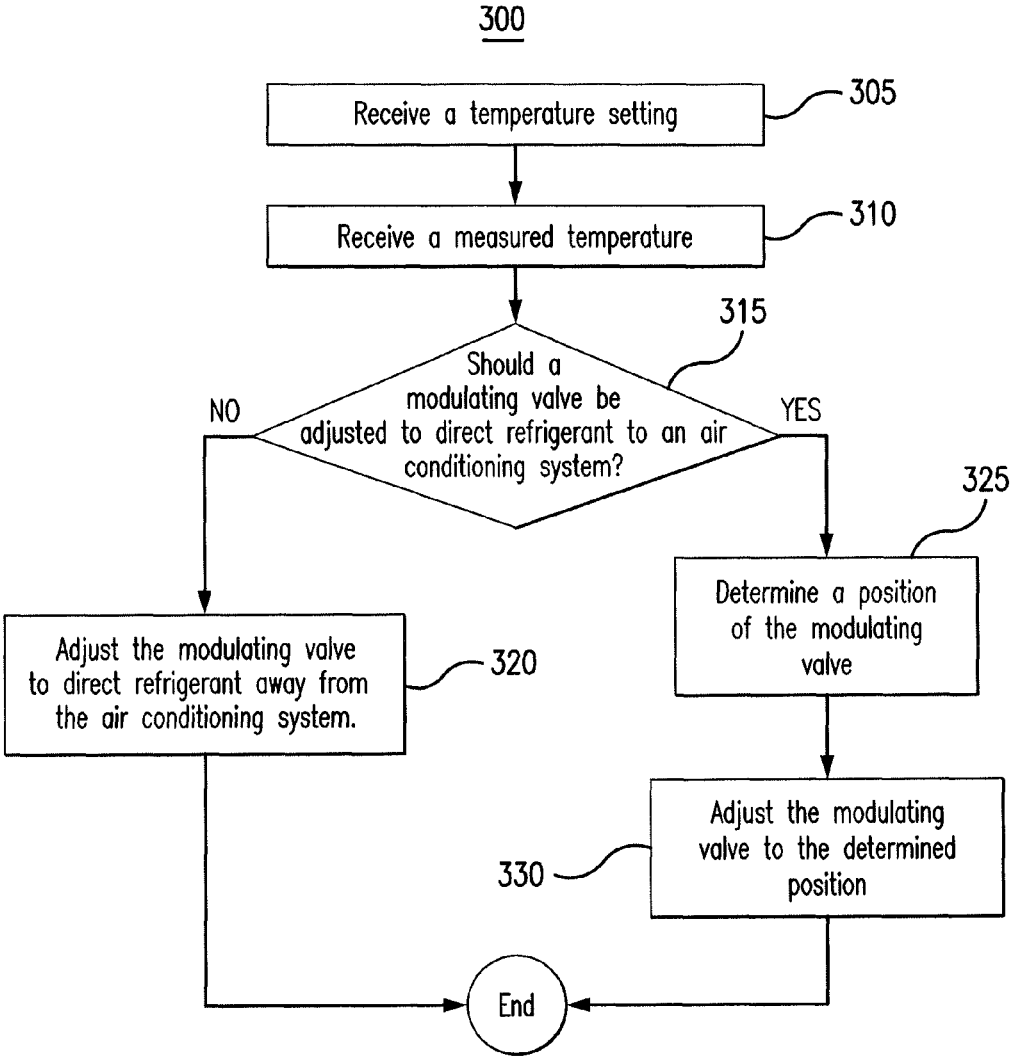
FIG. 3 is a flowchart illustrating an example method for controlling the air conditioning branch of the system of FIG. 1.

Embodiments of the present disclosure and its advantages are best understood by referring to FIGS. 1 through 3 of the drawings, like numerals being used for like and corresponding parts of the various drawings.

Integrated air conditioning and refrigeration systems may provide for the air conditioning and refrigeration needs of businesses such as, for example, grocery stores. The air conditioning portion of the integrated system may operate to cool the retail space of the business to provide comfort to customers. The refrigeration branch of the system may be used to operate refrigeration units that keep products frozen and/or cool. The air conditioning system and refrigeration system may be integrated using a carbon dioxide ($CO_2$) booster system. The $CO_2$ booster system is configured with a flash tank capable of holding refrigerant.

In the $CO_2$ booster system, refrigerant may flow from the flash tank to the refrigeration system so that the refrigeration system may be used to refrigerate products. The refrigerant may flow from the refrigeration system to one or more compressors. From the compressors, the refrigerant may flow to a high side heat exchanger.

The air conditioning system may be configured in a number of ways. For example, the air conditioning system may be configured in a dry expansion (DX) configuration. In the DX configuration, the air conditioning system may be positioned between the high side heat exchanger and the flash tank. Refrigerant may flow from the high side heat exchanger to the evaporator and/or heat exchanger of the air conditioning system and then to the flash tank. In this configuration there would be no control of the flow of the refrigerant from the high side heat exchanger to the air conditioning system and then to the flash tank. As a result there may be a significant pressure drop in the refrigerant line between the high side heat exchanger and the flash tank.

As another example, the air conditioning system may be configured in a flooded configuration. In this configuration, the air conditioning system may be positioned in such a manner so that gravity pulls refrigerant from the flash tank to the air conditioning system. The refrigerant may cycle through the air conditioning system and return to the flash tank. The flooded configuration may result in oil building up in the air conditioning system. The refrigerant may include small amounts of oil when the refrigerant passes through the evaporator and/or heat exchanger of the air conditioning system. Evaporated refrigerant may leave oil residue behind on the evaporator and/or heat exchanger. Over time, oil may build up on the evaporator and/or heat exchanger which may require maintenance or cleaning of the air conditioning system.

This disclosure contemplates a configuration of the air conditioning system in the $CO_2$ booster system that reduces the pressure drop in the refrigerant line between the high side heat exchanger and the flash tank associated with the DX configuration and reduces the oil buildup in the air conditioning system associated with the flooded configuration. In the contemplated configuration, the air conditioning system is positioned between a high pressure expansion valve coupled to the high side heat exchanger and the flash tank similar to the DX configuration. However, a modulating valve is positioned between the high pressure expansion valve and the air conditioning system. An input of the modulating valve may be connected to the high pressure expansion valve. The outputs of the modulating valve may be connected to the air conditioning system and to the flash tank. The modulating valve may control the flow of refrigerant to the air conditioning system and to the flash tank. For example, the modulating valve may direct the refrigerant to the air conditioning system. As another example, the modulating valve may direct the refrigerant to the flash tank. As yet another example, the modulating valve may direct a portion of the refrigerant to the air conditioning system and the remaining portion to the flash tank. In this manner, the amount of refrigerant flowing to the air conditioning system may be controlled, which may reduce the pressure drop in the refrigerant line between the high side heat exchanger and the flash tank. Furthermore, because gravity is not being used to pull the refrigerant from the flash tank into the air conditioning system, this configuration may also reduce oil buildup in the air conditioning system.

The contemplated configuration will be discussed in more detail using FIGS. 1 through 3. FIG. 1 will discuss the configuration generally. FIG. 2 will discuss the configuration in more detail. FIG. 3 will describe a method of operating the contemplated configuration.

FIG. 1 illustrates an example air conditioning and refrigeration system 100. System 100 may be configured as a $CO_2$ booster system. As provided in FIG. 1, system 100 may include a high side heat exchanger 105, a high pressure expansion valve 110, a modulating valve 115, a heat exchanger 120, a flash tank 125, a low temperature evaporator 130, a medium temperature evaporator, 135, a low temperature compressor 140, a medium temperature compressor 145, and a parallel compressor 150. Refrigerant may flow between and amongst the various components of system 100. In particular embodiments, system 100 may reduce the pressure drop in the refrigerant line between high side heat exchanger 105 and flash tank 125. In certain embodiments, system 100 may reduce the amount of oil buildup in heat exchanger 120.

High side heat exchanger 105 may remove heat from and/or circulate refrigerant to other components of system 100. High side heat exchanger 105 may remove heat from the refrigerant and cycle that heat away from system 100. For example, high side heat exchanger 105 may cycle heat into the air and/or into water. In particular embodiments, high side heat exchanger 105 may operate a gas cooler and remove heat from a gaseous refrigerant without changing the state of the refrigerant. In some embodiments, high side heat exchanger 105 may operate as a condenser and change the state of gaseous refrigerant to a liquid. In certain embodiments, the refrigerant in high side heat exchanger 105 may be at 1400 pounds per square inch gauge (psig).

High pressure expansion valve 110 may be coupled to the output of high side heat exchanger 105. Refrigerant may flow from high side heat exchanger 105 to high pressure expansion valve 110. High pressure expansion valve 110 may reduce pressure from the refrigerant flowing into high pressure expansion valve 110. As a result, the temperature of the refrigerant may drop as pressure is reduced. As a result, warm or hot refrigerant entering high pressure expansion valve 110 may be cold when leaving high pressure expansion valve 110. Refrigerant leaving high pressure expansion valve 110 may be fed into heat exchanger 120 and/or flash tank 125.

Modulating valve 115 may be coupled to the output of high pressure expansion valve 110. Refrigerant may flow from high pressure expansion valve 110 into modulating valve 115. In particular embodiments, modulating valve 115 may be controlled to direct the flow of refrigerant into heat exchanger 120 and/or flash tank 125. For example, if the air conditioning system of system 100 should be running to cool a space, modulating valve 115 may direct refrigerant to flow to heat exchanger 120. As another example, if the air conditioning system should not be running, then modulating valve 115 may direct refrigerant to flow to flash tank 125. Depending on the amount of heat to be removed by the air conditioning system, modulating valve 115 may be configured to direct a portion of the refrigerant to flow to heat exchanger 120 and the remaining portion of the refrigerant to flow to flash tank 125. This disclosure contemplates modulating valve 115 being controlled in any appropriate manner. For example, modulating valve 115 may be controlled by a motor and/or a controller such as, for example, a thermostat. In certain embodiments, modulating valve 115 may be positioned as close as possible to the outlet of high pressure expansion valve 110. In this manner, flow separation of the refrigerant may be minimized and a homogenous flow may be modulated.

Although this disclosure illustrates modulating valve 115 as a three-way modulating valve, this disclosure contemplates that modulating valve 115 may also be a two-way modulating valve. In that configuration, when the two-way valve is open refrigerant may flow to heat exchanger 120. When the two-way valve is closed the refrigerant line to heat exchanger 120 may be blocked and the refrigerant may, in essence, overflow to flash tank 125.

Heat exchanger 120 may be included in the air conditioning system of system 100. Heat exchanger 120 may be configured to receive refrigerant. As the refrigerant passes through heat exchanger 120, the refrigerant may remove heat from a coolant, such as water for example, that is also flowing through heat exchanger 120. As a result, that coolant may be cooled. The coolant may then flow to other portions of the air conditioning system to remove heat from air. As heat is removed from the air, the air cools. The cooled air may then be circulated such as, for example, by a fan through a space to cool the space. After the refrigerant removes heat from the coolant, the refrigerant may become warmer. The warmer refrigerant may leave heat exchanger 120 and flow into flash tank 125.

In particular embodiments, heat exchanger 120 may incorporate a liquid separator and plate heat exchangers. Heat exchanger 120 may be configured in a $CO_2$ flooded evaporator configuration. In this manner, the pressure drop in the refrigerant line across heat exchanger 120 may be reduced. Furthermore, the efficiency of heat exchanger 120 may be improved.

Flash tank 125 may receive refrigerant from modulating valve 115 and/or heat exchanger 120. Flash tank 125 may be configured to hold refrigerant in a partially liquid state and partially gaseous state. In certain embodiments, flash tank 125 may hold refrigerant around 535 psig. The refrigerant in flash tank 125 may flow to other portions of system 100 such as, for example, the refrigeration system.

The refrigeration system may include a low temperature portion and a medium temperature portion. The low temperature portion may operate at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods and the medium temperature portion may include refrigerated shelves used to hold produce. Refrigerant may flow from flash tank 125 to both the low temperature and medium temperature portions of the refrigeration system. For example, the refrigerant may flow to low temperature evaporator 130 and medium temperature evaporator 135. When the refrigerant reaches low temperature evaporator 130 or medium temperature evaporator 135, the refrigerant removes heat from the air around low temperature evaporator 130 or medium temperature evaporator 135. As a result, the air is cooled. The cooled air may then be circulated such as, for example, by a fan to cool a space such as, for example, a freezer and/or a refrigerated shelf. As refrigerant passes through low temperature evaporator 130 and medium temperature evaporator 135 the refrigerant may change from a liquid state to a gaseous state.

In particular embodiments, expansion valves may be positioned between flash tank 125 and low temperature evaporator 130 and medium temperature evaporator 135. For example, a low temperature expansion valve may be positioned in the refrigerant line between low temperature evaporator 130 and flash tank 125 and a medium temperature expansion valve may be positioned in the refrigerant line between flash tank 125 and medium temperature evaporator 135. These expansion valves may reduce pressure from the refrigerant leaving flash tank 125 which may reduce the temperature of the refrigerant. The cooler refrigerant may then be used by low temperature evaporator 130 and medium temperature evaporator 135 to cool air.

Refrigerant may flow from low temperature evaporator 130 and medium temperature evaporator 135 to compressors. System 100 may include a low temperature compressor 140 and a medium temperature compressor 145. This disclosure contemplates system 100 including any number of low temperature compressors 140 and medium temperature compressors 145. Both the low temperature compressor 140 and medium temperature compressor 145 may be configured to increase the pressure of the refrigerant. As a result, the heat in the refrigerant may become concentrated and the refrigerant may become a high pressure gas. Low temperature compressor 140 may compress refrigerant from 200 psig to 420 psig. Medium temperature compressor 145 may compress refrigerant from 420 psig to 1400 psig. The output of low temperature compressor 140 may be coupled to the input of medium temperature compressor 145. The output of medium temperature compressor 145 may be coupled to high side heat exchanger 105.

Because flash tank 125 holds refrigerant that is partially gaseous, the gaseous refrigerant may be passed to a compressor rather than to the refrigeration system. Parallel compressor 150 may receive gaseous refrigerant from flash tank 125 and compress the gaseous refrigerant. For example, parallel compressor 150 may compress gas from 535 psig to 1400 psig. Parallel compressor 150 may pass the compressed gaseous refrigerant to high side heat exchanger 105. This disclosure contemplates system 100 including any number of parallel compressors 150.

In particular embodiments, system 100 may reduce the pressure drop in the refrigerant line between high pressure expansion valve 110 and flash tank 125. For example, by directing refrigerating away from heat exchanger 120, the refrigerant may flow directly from high pressure expansion valve 110 to flash tank 125, thereby maintaining the pressure in the refrigerant line. Furthermore, in certain embodiments, system 100 may reduce the oil buildup in heat exchanger 120. For example, by placing heat exchanger 120 between high side heat exchanger 105 and flash tank 125, the oil buildup in heat exchanger 120 may be reduced. FIGS. 2 and 3 will describe the operation of system 100 in more detail.

FIG. 2 illustrates an example air conditioning branch of the system 100 of FIG. 1. As provided in FIG. 2, the air conditioning branch may include modulating valve 115, heat exchanger 120, and flash tank 125. Refrigerant may flow from modulating valve 115 to heat exchanger 120 and/or flash tank 125. Modulating valve 115 may be controlled to direct the flow of refrigerant to heat exchanger 120 and/or flash tank 125, which in particular embodiments may reduce the pressure drop in the refrigerant line across the air conditioning branch and which may reduce oil buildup in heat exchanger 120. For the purpose of clarity, certain elements of system 100 have not been illustrated in FIG. 2. However, their omission should not be construed as their removal from system 100.

Modulating valve 115 may be coupled to motor 200. Motor 200 may control the state of modulating valve 115. For example, motor 200 may cause modulating valve 115 to be in a first state where refrigerant may flow from modulating valve 115 to heat exchanger 120. As another example, motor 200 may cause modulating valve 115 to be in a second state where refrigerant flows from modulating valve 115 to flash tank 125. As yet another example, motor 200 may cause modulating valve 115 to be in a third state where a portion of the refrigerant flows from modulating valve 115 to heat exchanger 120 and the remaining portion of the refrigerant flows from modulating valve 115 to flash tank 125. Motor 200 may be an electric motor, a gas motor, or any other appropriate motor for changing the state of modulating valve 115. In particular embodiments, modulating valve 115 and motor 200 may be included in the same housing.

The state of modulating valve 115 may also be controlled by controller 205. As provided in FIG. 2, controller 205 may be coupled to motor 200. In particular embodiments, controller 205 may control motor 200 to adjust the state of modulating valve 115. In other embodiments, controller 205 may be coupled directly to modulating valve 115 and may directly control the state of modulating valve 115. In certain embodiments, controller 205 may be included in the same housing as motor 200 and/or modulating valve 115. Controller 205 may include a processor and a memory configured to perform any of the operations of controller 205 described herein.

The processor may execute software stored on the memory to perform any of the functions of controller 205 or motor 200 described herein. The processor may control the operation and administration of controller 205 or motor 200 by processing information received from other components of system 100. The processor may include any hardware and/or software that operates to control and process information. The processor may be a programmable logic device, a microcontroller, a microprocessor, any suitable processing device, or any suitable combination of the preceding.

The memory may store, either permanently or temporarily, data, operational software, or other information for the processor. The memory may include any one or a combination of volatile or non-volatile local or remote devices suitable for storing information. For example, the memory may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in the memory, a disk, a CD, or a flash drive. In particular embodiments, the software may include an application executable by the processor to perform one or more of the functions described herein.

Controller 205 may adjust the state of modulating valve 115 based on measured characteristics of the air conditioning system. For example, controller 205 may be a thermostat that receives measured temperatures of the air in the space cooled by the air conditioning system. Based on that air temperature, controller 205 may adjust modulating valve 115 to direct refrigerant to heat exchanger 120 or away from heat exchanger 120 to flash tank 125. As another example, controller 205 may receive a measured temperature of the coolant in heat exchanger 120. The temperature of the coolant may indicate the amount of heat being removed from the space cooled by the air conditioning system. If that coolant is too hot, controller 205 may adjust modulating valve 115 to direct more refrigerant to heat exchanger 120. As yet another example, controller 205 may receive a measured pressure of a gas in heat exchanger 120. As with the measured temperatures, controller 205 may adjust modulating valve 115 to direct refrigerant to heat exchanger 120 or away from heat exchanger 120 based on that measured gas pressure.

As previously described, heat exchanger 120 may use refrigerant to remove heat from coolant. The cooled coolant may then be used to cool air that may be circulated throughout a space. Flash tank 125 may store refrigerant in both a gaseous and a liquid state. In particular embodiments, because the flow of refrigerant to heat exchanger 120 may be controlled by modulating valve 115, the pressure drop in the refrigerant line across heat exchanger 120 may be reduced. In certain embodiments, because the flow of refrigerant to heat exchanger 120 may be controlled by modulating valve 115, oil buildup in heat exchanger 120 may be reduced.

In particular embodiments, by adjusting the state of modulating valve 115, the pressure drop in the refrigerant line from high side heat exchanger 105 to flash tank 125 may be reduced. For example, by directing refrigerant away from heat exchanger 120 and to flash tank 125, the pressure in the refrigerant line may be maintained. Furthermore, in certain embodiments, by placing heat exchanger 120 between high side heat exchanger 105 and flash tank 125, oil buildup in heat exchanger 120 may be reduced.

FIG. 3 is a flowchart illustrating an example method 300 for controlling the air conditioning branch of the system 100 of FIG. 1. In particular embodiments, controller 205 may perform method 300.

Controller 205 may begin by receiving a temperature setting in step 305. For example, controller 205 may receive the temperature setting from the thermostat. A user may adjust the temperature setting on the thermostat. In step 310, controller 205 may receive a measured temperature. The measured temperature may be the temperature of the air of the space cooled by the air conditioning system. In certain embodiments, the measured temperature may be the temperature of coolant used to remove heat from air cooled by the air conditioning system. This disclosure also contemplates controller 205 receiving a measured temperature of coolant in an air conditioning system or a measured pressure of gas in an air conditioning system.

In step 315, controller 205 may determine whether a modulating valve should be adjusted to direct refrigerant to the air conditioning system. In certain embodiments, controller 205 may make this determination based on the temperature setting and the measured temperature. For example, if the measured temperature is higher than the temperature setting, then controller 205 may determine that the air conditioning system should be turned on. Controller 205 may then determine that the modulating valve should be adjusted to direct refrigerant to the air conditioning system. If the measured temperature is less than the temperature setting, then controller 205 may determine that the modulating valve should be adjusted to direct refrigerant away from the air conditioning system. If controller 205 determines that the modulating valve should be adjusted to direct refrigerant away from the air conditioning system, controller 205 may make that adjustment in step 320. As a result, refrigerant will flow to a flash tank.

If controller 205 determines that the modulating valve should be adjusted to direct refrigerant to the air conditioning system, then controller 205 may determine a position of the modulating valve in step 325. The determined position may affect how much refrigerant is directed to the air conditioning system. For example, if the difference between the measured temperature and the temperature setting is low, then controller 205 may determine a position of the modulating valve that directs only a small portion of the refrigerant to flow to the air conditioning system. If the difference between the temperature setting and the measured temperature is great, then controller 205 may determine that a majority or all of the refrigerant flow should be directed to the air conditioning system. In step 330, controller 205 may adjust the modulating valve to the determined position. In this manner, the amount of refrigerant directed to the air conditioning system may be adjusted based on the needs of the air conditioner. For example, if the air conditioner is off, the refrigerant may be directed away from the air conditioner to the flash tank. As a result, the pressure drop from the high side heat exchanger to the flash tank may be reduced. Furthermore, oil buildup in the air conditioner may be reduced.

Modifications, additions, or omissions may be made to method 300 depicted in FIG. 3. Method 300 may include more, fewer, or other steps. For example, steps may be performed in parallel or in any suitable order. While discussed as controller 205 performing the steps, any suitable component of system 100, such as modulating valve 115 and/or motor 200 for example, may perform one or more steps of the method.

Modifications, additions, or omissions may be made to the present disclosure without departing from the scope of the invention. For example, the components of system 100 may be integrated or separated. As another example, controller 205 and motor 200 may be integrated. As yet another example, modulating valve 115, motor 200, and/or controller 205 may be integrated.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a high side heat exchanger configured to remove heat from refrigerant;

a modulating valve configured to control a flow of refrigerant from the high side heat exchanger to both a second heat exchanger and a flash tank, the modulating valve configured to operate in a first state, a second state, and a third state, wherein:

the modulating valve directs all of the refrigerant flowing through the modulating valve to the second heat exchanger when the modulating valve is operating in the first state;

the modulating valve directs all of the refrigerant flowing through the modulating valve to the flash tank when the modulating valve is operating in the second state; and the modulating valve directs a first portion of the refrigerant flowing through the modulating valve to the second heat exchanger and a second portion of the refrigerant flowing through the modulating valve to the flash tank when the modulating valve is operating in the third state;

the flash tank configured to store refrigerant from the second heat exchanger and from the high side heat exchanger;

a parallel compressor configured to compress refrigerant from the flash tank and to send the compressed refrigerant to the high side heat exchanger;

a first evaporator configured to receive the refrigerant from the flash tank;

a second evaporator configured to receive the refrigerant from the flash tank;

a first compressor configured to compress the refrigerant from the first evaporator; and a second compressor configured to compress the refrigerant from the second evaporator and from the first compressor, the second compressor further configured to send the refrigerant to the high side heat exchanger.

2. The system of claim 1, wherein the flow of refrigerant from the high side heat exchanger to the second heat exchanger is controlled based on one or more of a temperature of a coolant in the high side heat exchanger and a pressure of a gas in the second heat exchanger.

3. The system of claim 1, wherein the modulating valve is a 2-way modulating valve or a 3-way modulating valve.

4. The system of claim 1, further comprising an air conditioning unit comprising the heat exchanger.

5. The system of claim 1, wherein the modulating valve comprises a motor.

6. The system of claim 1, wherein the first evaporator is configured to operate at a lower temperature than the second evaporator.

7. A system comprising:

a modulating valve configured to control a flow of refrigerant from a high side heat exchanger to both a heat exchanger and a flash tank, wherein a first and second evaporator receive the refrigerant from the flash tank, a first compressor compresses the refrigerant from the first evaporator, a second compressor compresses the refrigerant from the second evaporator, and the second compressor sends the refrigerant to the high side heat exchanger;

a motor coupled to the modulating valve, the motor configured to adjust the modulating valve; and a controller configured to:

determine whether the modulating valve should direct refrigerant to the heat exchanger;

in response to a determination that the modulating valve should direct refrigerant to the heat exchanger, control the motor to adjust the modulating valve to direct refrigerant to both the heat exchanger and to the flash tank; and in response to a determination that the modulating valve should direct refrigerant away from the heat exchanger, control the motor to adjust the modulating valve to direct all of the refrigerant flowing through the modulating valve to the flash tank.

8. The system of claim 7, wherein the determination whether the modulating valve should direct refrigerant to or away from the heat exchanger is based on one or more of a temperature of a coolant in the heat exchanger and a pressure of a gas in the heat exchanger.

9. The system of claim 7, wherein the modulating valve is a 2-way modulating valve or a 3-way modulating valve.

10. The system of claim 7, wherein an air conditioning unit comprises the heat exchanger.

11. The system of claim 7, wherein the first evaporator is configured to operate at a lower temperature than the second evaporator.

12. A method comprising:

determining whether a modulating valve should direct refrigerant to a heat exchanger, the modulating valve configured to control the flow of refrigerant from a high side heat exchanger to both the heat exchanger and a flash tank, wherein a first and second evaporator receive the refrigerant from the flash tank, a first compressor compresses the refrigerant from the first evaporator, a second compressor compresses the refrigerant from the second evaporator, and the second compressor sends the refrigerant to the high side heat exchanger;

in response to a determination that the modulating valve should direct refrigerant away from the heat exchanger, adjusting the modulating valve to direct refrigerant to the flash tank; and in response to a determination that the modulating valve should to direct refrigerant to the heat exchanger, adjusting the modulating valve to direct refrigerant to both the heat exchanger and the flash tank, the flash tank configured to store refrigerant from the heat exchanger and from the high side heat exchanger.

13. The method of claim 12, wherein determining whether the modulating valve should to direct refrigerant to or away from the heat exchanger is based on one or more of a temperature of a coolant in the heat exchanger and a pressure of a gas in the heat exchanger.

14. The method of claim 12, wherein the modulating valve is a 2-way modulating valve or a 3-way modulating valve.

15. The method of claim 12, wherein an air conditioning unit comprises the heat exchanger.

16. The method of claim 12, wherein the modulating valve comprises a motor.

17. The method of claim 12, wherein the first evaporator is configured to operate at a lower temperature than the second evaporator.

* * * * *